US009316090B2

(12) United States Patent
Walton et al.

(10) Patent No.: US 9,316,090 B2
(45) Date of Patent: Apr. 19, 2016

(54) METHOD OF REMOVING A DISSOLVABLE WELLBORE ISOLATION DEVICE

(71) Applicant: HALLIBURTON ENERGY SERVICES, INC., Houston, TX (US)

(72) Inventors: Zachary W. Walton, Duncan, OK (US); Matthew T. Howell, Duncan, OK (US); Matt J. Merron, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 394 days.

(21) Appl. No.: 13/889,073

(22) Filed: May 7, 2013

(65) Prior Publication Data

US 2014/0332233 A1 Nov. 13, 2014

(51) Int. Cl.

| | |
|---|---|
| ***E21B 34/06*** | (2006.01) |
| ***E21B 33/12*** | (2006.01) |
| ***E21B 23/04*** | (2006.01) |

(52) U.S. Cl.

CPC ..... *E21B 34/063* (2013.01); *E21B 33/1208* (2013.01)

(58) Field of Classification Search

CPC ..... E21B 29/02; E21B 29/00; E21B 34/063; E21B 23/04; E21B 33/1208

See application file for complete search history.

(56) References Cited

U.S. PATENT DOCUMENTS

| | | | | |
|---|---|---|---|---|
| 2008/0135249 | A1* | 6/2008 | Fripp et al. | 166/285 |
| 2013/0146302 | A1* | 6/2013 | Gaudette et al. | 166/376 |

* cited by examiner

*Primary Examiner* — Cathleen Hutchins

(74) *Attorney, Agent, or Firm* — McGuireWoods, LLP

(57) ABSTRACT

A wellbore isolation device comprises: a first layer, wherein the first layer: (A) comprises a first material; and (B) defines a cavity containing a dissolution medium, wherein a chemical reaction of at least the dissolution medium causes at least a portion of the first material to dissolve. A method of removing the wellbore isolation device comprises: introducing the wellbore isolation device containing the dissolution medium into the wellbore; and allowing the chemical reaction to occur.

19 Claims, 3 Drawing Sheets

METHOD OF REMOVING A DISSOLVABLE WELLBORE ISOLATION DEVICE

TECHNICAL FIELD

An isolation device and methods of removing the isolation device are provided. The isolation device includes at least a first layer that overlays a cavity containing a dissolution medium. The dissolution medium is capable of dissolving at least a portion of the first layer. According to an embodiment, the isolation device is used in an oil or gas well operation. Several factors can be adjusted to control the rate of dissolution of the first layer in a desired amount of time.

SUMMARY

According to an embodiment, a wellbore isolation device comprises: (A) at least a first layer, wherein the first layer comprises at least a first material, and wherein the first layer defines a cavity located within the first layer, and (B) a dissolution medium located within the cavity, wherein a chemical reaction of at least the dissolution medium causes at least a portion of the first material to dissolve.

According to another embodiment, a method of removing a wellbore isolation device comprises: introducing the isolation device into a wellbore, and allowing the chemical reaction to occur.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
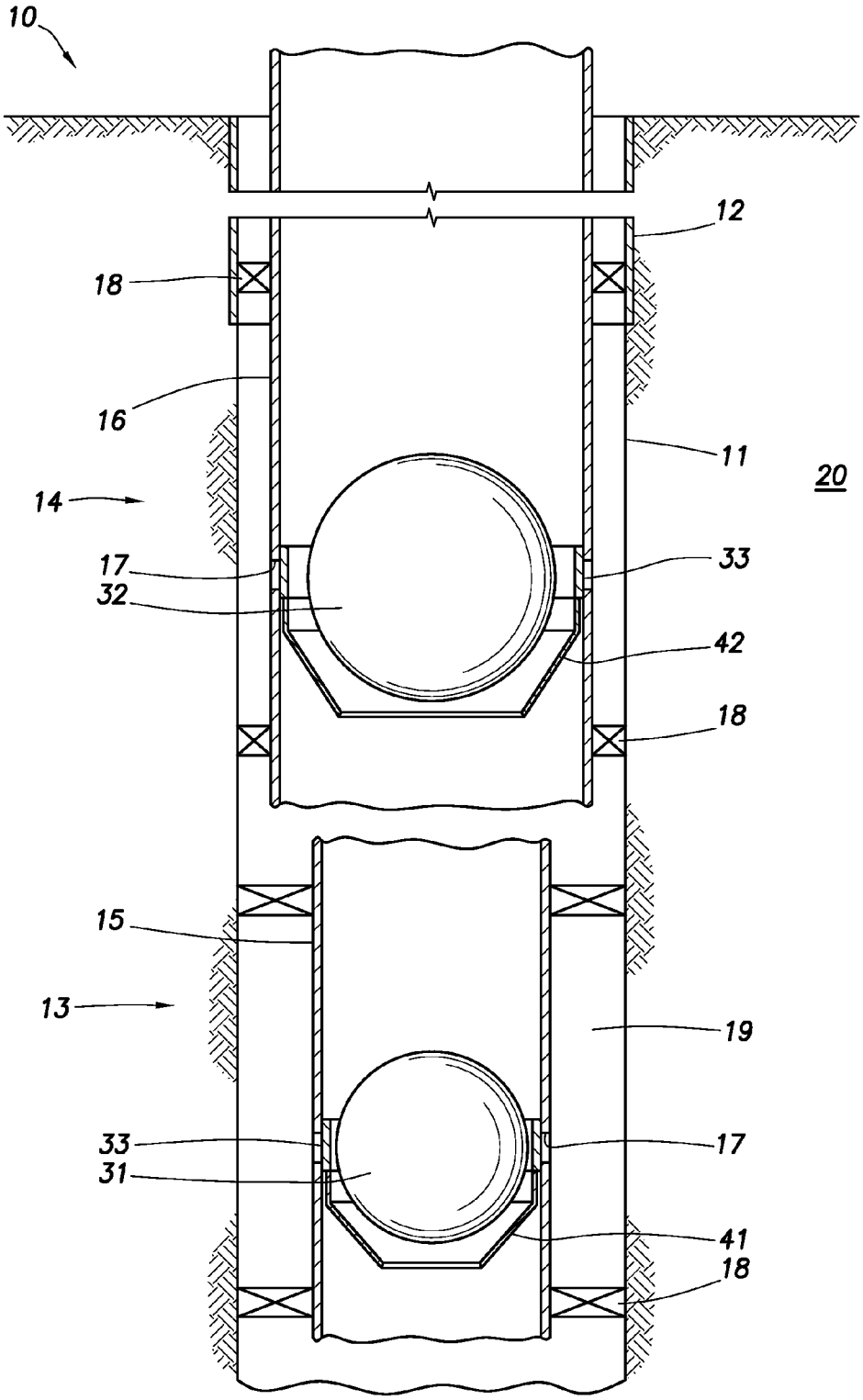
FIG. 1 depicts a well system containing more than one isolation device.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more layers, materials, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device. An isolation device can be used for zonal isolation and functions to block fluid flow within a tubular, such as a tubing string, or within an annulus. The blockage of fluid flow prevents the fluid from flowing across the isolation device in any direction and isolate the zone of interest. As used herein, the relative term "downstream" means at a location further away from a wellhead. In this manner, treatment techniques can be performed within the zone of interest.

Common isolation devices include, but are not limited to, a ball and a seat, a bridge plug, a packer, a plug, and wiper plug. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished via a ball and seat by dropping the ball from the wellhead onto the seat that is located within the wellbore. The ball engages with the seat, and the seal created by this engagement prevents fluid communication into other zones downstream of the ball and seat. In order to treat more than one zone using a ball and seat, the wellbore can contain more than one ball seat. For example, a seat can be located within each zone. Generally, the inner diameter (I.D.) of the tubing string where the ball seats are located is different for each zone. For example, the I.D. of the tubing string sequentially decreases at each zone, moving from the wellhead to the bottom of the well. In this manner, a smaller ball is first dropped into a first zone that is the farthest downstream; that zone is treated; a slightly larger ball is then dropped into another zone that is located upstream of the first zone; that zone is then treated; and the process continues in this fashion—moving upstream along the wellbore—until all the desired zones have been treated. As used herein, the relative term "upstream" means at a location closer to the wellhead.

A bridge plug is composed primarily of slips, a plug mandrel, and a rubber sealing element. A bridge plug can be introduced into a wellbore and the sealing element can be caused to block fluid flow into downstream zones. A packer generally consists of a sealing device, a holding or setting device, and an inside passage for fluids. A packer can be used to block fluid flow through the annulus located between the outside of a tubular and the wall of the wellbore or inside of a casing.

Isolation devices can be classified as permanent or retrievable. While permanent isolation devices are generally designed to remain in the wellbore after use, retrievable devices are capable of being removed after use. It is often desirable to use a retrievable isolation device in order to avoid plugging the wellbore and to restore fluid communication between one or more zones. Traditionally, isolation devices are retrieved by inserting a retrieval tool into the wellbore, wherein the retrieval tool engages with the isolation device, attaches to the isolation device, and the isolation device is then removed from the wellbore. Another way to remove an isolation device from the wellbore is to mill at least a portion or all of the device. Yet, another way to remove an isolation device is to contact the device with a solvent, such as an acid, thus dissolving all or a portion of the device. Previous methods to dissolve a portion of the device involve dissolving the device from the outside by, for example, introducing a fluid to come in contact with the device.

However, some of the disadvantages to using traditional methods to remove a retrievable isolation device include: it can be difficult and time consuming to use a retrieval tool; milling can be time consuming and costly; and fluids used to dissolve the device from the outside can adversely impact oil or gas operations, such as adversely affecting other fluids being used in a wellbore, requiring a higher volume of the dissolving fluid due to mixing with other fluids, and inadequate or only partial dissolution of the isolation device.

There exists a need for improved methods of removing an isolation device. It has been discovered that a novel method of removing an isolation device can include allowing a dissolution medium to dissolve at least a portion of a first layer of the isolation device. The first layer defines a cavity containing the dissolution medium. Thus, dissolution of the portion of the first layer is achieved from within or inside the isolation device. The rate of dissolution can be controlled via a variety of mechanisms, such as by positioning a second layer between the first layer and the dissolution medium.

Acid dissolution occurs when metals or metal alloys are brought in reactive contact with an acid. The phrase "reactive contact" means that a reaction occurs when the acid and metal or metal alloys are brought in close contact. The reaction results in a partial or complete dissolution of the metals or metal alloys. It is to be understood that as used herein, the term "metal" is meant to include pure metals and also metal alloys without the need to continually specify that the metal can also be a metal alloy. Moreover, the use of the phrase "metal or metal alloy" in one sentence or paragraph does not mean that the mere use of the word "metal" in another sentence or paragraph is meant to exclude a metal alloy. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin. Additionally, while the foregoing discussion refers to metals or metal alloys, it is readily apparent that any suitable material, including thermoplastics and composites, that can be dissolved by a suitable medium, may be used instead of metals or metal alloys. Furthermore, while the foregoing discussion refers to an acid, any suitable dissolution medium can be used. As used herein, the phrase "dissolution medium" means a substance, for example, a fluid or solvent that is capable of undergoing a chemical reaction and dissolving a material. The reaction is typically a chemical reaction. As used herein, the term "dissolve" means decomposition, degradation, melting, eating away, disintegration or corrosion of the material.

There are several factors that can affect the rate of dissolution of a material by a dissolution medium. One of the factors is the composition of the dissolution medium. For example, a material like aluminum may be easily dissolved by a dissolution medium comprising hydrochloric acid (HCl) while a material like stainless steel may be easily dissolved by a dissolution medium comprising ferric chloride ($FeCl_3$). Other factors include the volume and concentration of the dissolution medium. Yet another factor is the surface area of the material that is contacted with the dissolution medium. The rate of dissolution, by an acid, for example, is inversely related to the surface area of a metal. The rate of dissolution can also be a function of time. In general, the rate of dissolution of a material is directly proportional to the length of time the material is exposed to a suitable dissolution medium. It has been observed that dissolution in a dissolution medium such as, acid, progresses at a faster rate and in a more complete manner if the reaction is confined to a closed vessel.

Acid dissolution may typically generate hydrogen and other gases and also produce a salt. Generally, acid-metal reactions are exothermic in nature. In an exothermic reaction involving an acid and a metal, the heat evolved from the reaction has a temperature greater than or equal to the melting point of the metal.

Most common non-oxidizing acids, such as hydrochloric acid (HCl), are capable of forming a complex—that is, forming chemical compounds by joining ions to a central metallic atom by coordinate bonds. This characteristic facilitates dissolution of the metal. The dissolving strength of HCl depends in part on the stability of chloride complexes that form with the metal cations. Ferromagnetic metals, such as iron, nickel and cobalt, and alkaline earth metals, such as aluminum, cadmium, zinc, indium and tin, can be dissolved when contacted with a suitable acid. In some instances, it may be beneficial to introduce a catalyst. A catalyst can increase the rate of a chemical reaction or be used to start a chemical reaction. For example, the dissolution of aluminum by HCl is accelerated in the presence of metallic mercury. The dissolution of the metal may also be facilitated by adding a mixture of acids. For example, the addition of copper (II) chloride or mercury (II) chloride to HCl greatly speeds the dissolution of aluminum.

According to an embodiment, a wellbore isolation device comprises: (A) at least a first layer, wherein the first layer comprises at least a first material, and wherein the first layer defines a cavity located within the first layer; and (B) a dissolution medium located within the cavity, and wherein a chemical reaction of at least the dissolution medium causes at least a portion of the first material to be dissolved.

According to another embodiment, a method of removing a wellbore isolation device comprises: introducing the isolation device into a wellbore; and allowing the chemical reaction to occur.

Any discussion of the embodiments regarding the isolation device or any component related to the isolation device (e.g., the first layer, dissolution medium, etc.) is intended to apply to all of the apparatus and method embodiments.

Turning to the Figures, FIG. 1 depicts a well system 10. The well system 10 can include at least one wellbore 11. The wellbore 11 can penetrate a subterranean formation 20. The subterranean formation 20 can be a portion of a reservoir or adjacent to a reservoir. The wellbore 11 can include a casing 12. The wellbore 11 can include only a generally vertical wellbore section or can include only a generally horizontal wellbore section. A first section of tubing string 15 can be installed in the wellbore 11. A second section of tubing string 16 (as well as multiple other sections of tubing string, not shown) can be installed in the wellbore 11. The well system 10 can comprise at least a first zone 13 and a second zone 14. The well system 10 can also include more than two zones, for example, the well system 10 can further include a third zone, a fourth zone, and so on. The well system 10 can further include one or more packers 18. The packers 18 can be used in addition to the isolation device to isolate each zone of the wellbore 11. The isolation device can be the packers 18. The packers 18 can be used to prevent fluid flow between one or more zones (e.g., between the first zone 13 and the second zone 14) via an annulus 19. The tubing string 15/16 can also include one or more ports 17. The one or more ports 17 can be located in each section of the tubing string. Moreover, not every section of the tubing string needs to include one or more ports 17. For example, the first section of tubing string 15 can include one or more ports 17, while the second section of tubing string 16 does not contain a port. In this manner, fluid flow into the annulus 19 for a particular section can be selected based on the specific oil or gas operation to be performed.

It should be noted the well system 10 that is illustrated in the drawings and is described herein is merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement may be used instead of packers 18 to aid the isolation device in providing zonal isolation. Cement may also be used in addition to packers 18.

According to an embodiment, the isolation device is capable of restricting or preventing fluid flow between a first zone 13 and a second zone 14. The first zone 13 can be located upstream or downstream of the second zone 14. In this manner, depending on the oil or gas operation, fluid is restricted or prevented from flowing downstream or upstream into the second zone 14. Examples of isolation devices capable of restricting or preventing fluid flow between zones include, but are not limited to, a ball, and more specifically, a fracturing ball, a ball and a seat, a plug, a bridge plug, a wiper plug, and a packer.

Figure 2:
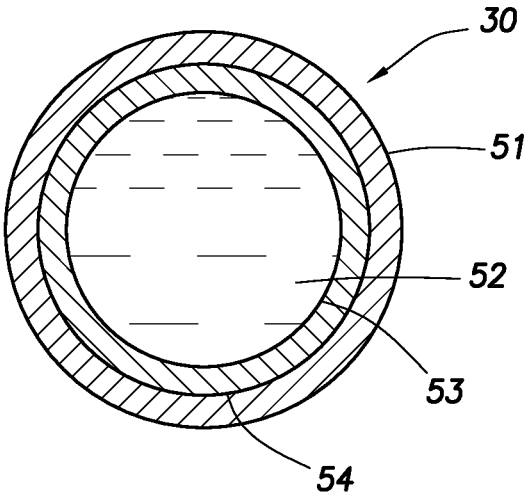
FIGS. 2-4 depict an isolation device according to different embodiments.
Figure 3:
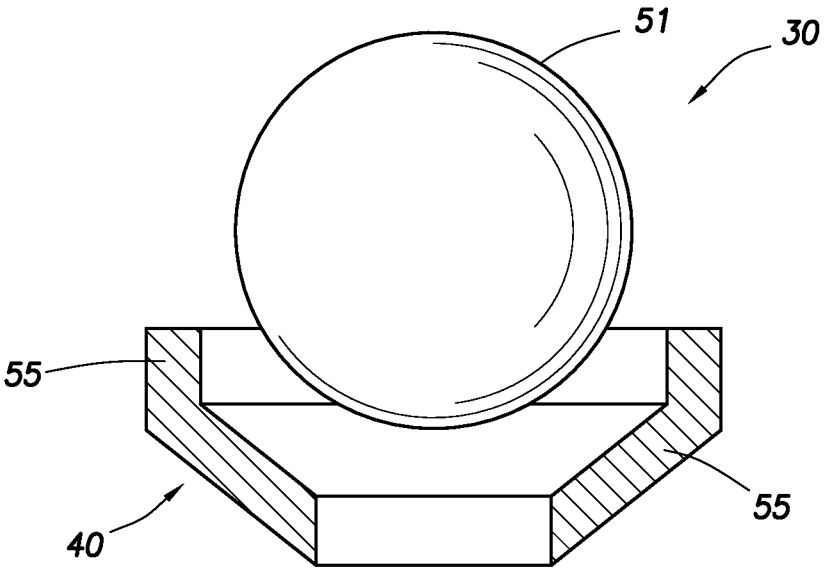
Figure 4:
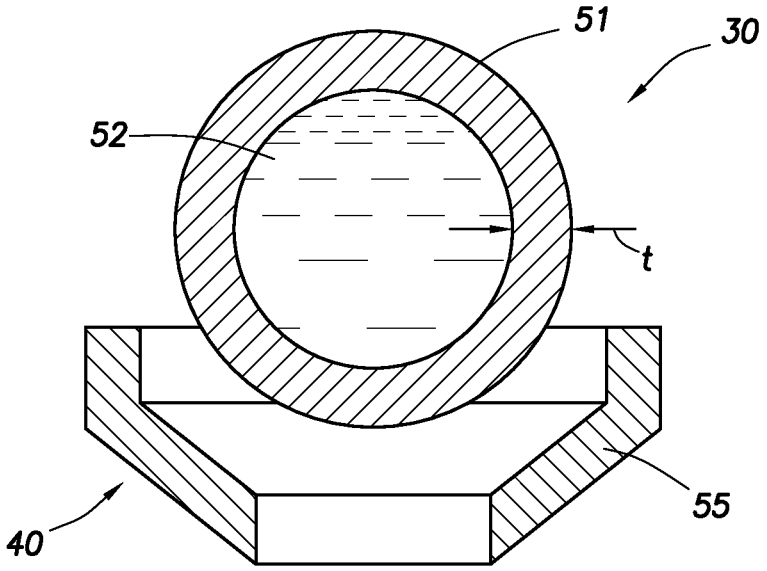

Referring to FIGS. 2-4, the isolation device comprises at least a first layer 51, wherein the first layer comprises at least a first material and wherein the first layer defines a cavity located within the first layer. The first layer 51 can be an outer layer that defines the cavity 53. The first layer 51 can be part of the body of the isolation device. For example, if the isolation device is a ball, then the first layer can be part of the shell of the ball—for a bridge plug, the first layer can be part of the mandrel—for a packer, the first layer can be part of the sealing device. It should be understood that the dissolution of the portion of the first material should be capable of allowing the isolation device to be removed from the wellbore. Therefore, the first layer should be a component of the isolation device that allows the isolation device to be removed from the wellbore in order to restore fluid communication between zones via dissolution of the portion of the first layer.

The first layer 51 comprises a first material. The first layer 51 can consist of the first material. The first layer can also comprise two or more materials. If the first layer comprises two or more materials, then the materials can be nuggets of material bonded together to form the first layer for example. The materials can also be compressed layers of the materials to form the first layer. The first material can be a metal, metal alloy, thermoplastic, a composite material, or combinations thereof. The metal or the metal of the metal alloy can be selected from the group consisting of, lithium, sodium, potassium, rubidium, cesium, francium, beryllium, magnesium, calcium, strontium, barium, radium, aluminum, gallium, indium, tin, thallium, lead, bismuth, scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold, graphite, and combinations thereof. Preferably, the metal or the metal of the metal alloy is selected from the group consisting of iron, aluminum, stainless steel, nickel, copper, zinc, and combinations thereof. According to an embodiment, the metal is neither radioactive, unstable, nor theoretical. A composite material is made of two or more constituent materials which can be chemically and physically different in characteristics. Unlike an alloy, it is not necessary for any of the constituent materials of a composite material to be a metal.

The isolation device includes the cavity 53. According to one embodiment, the cavity 53 is at least partially hollow. The isolation device also includes a dissolution medium, wherein the dissolution medium is located within the cavity. The cavity 53 can be fully or partially filled with the dissolution medium 52. The volume of the dissolution medium contained within the cavity can depend on the concentration of one or more ingredients in the medium and the desired rate of dissolution of the portion of the first layer, among other things. According to an embodiment, a reaction of at least the dissolution medium 52 causes at least a portion of the first material to dissolve. The reaction can also cause all of the materials making up the first layer 51 to partially or fully dissolve. The reaction can be a chemical reaction between the dissolution medium and the first material or between two or more reactants in the dissolution medium. The reaction can be a chemical acid dissolution reaction or by way of another example an exothermic reaction between reactants of the medium that dissolves via melting the portion of the first material. According to another embodiment, the first material is capable of at least partially dissolving when the first material is contacted with or allowed to come in contact with the dissolution medium 52. The dissolution of the first material causes dissolution of at least a portion of the first layer 51.

The dissolution medium 52 is completely contained within the cavity 53. The dissolution medium 52 can be a fluid or a mixture of fluids. Preferably, the dissolution medium 52 is an acid or a mixture of one or more acids. The composition of the dissolution medium 52 can be selected based on the composition of the first material and/or first layer. For example, if the first material is aluminum, then the dissolution medium 52 can be hydrochloric acid or if the first material is stainless steel, then the dissolution medium 52 can be ferric chloride.

In accordance with one embodiment, a pre-determined amount of the dissolution medium 52 can be filled or fitted within the first layer 51 at the well site prior to pumping or dropping the isolation device in the wellbore. For instance, hydrochloric acid can be filled inside the isolation device at the well site prior to use.

A pre-determined amount of the dissolution medium 52 can be contained inside the cavity 53. The pre-determined amount of the dissolution medium 52 can be an amount that is sufficient to at least partially dissolve the first material and the first layer 51. Stated another way, the amount of first material contained in the first layer and the volume of the dissolution medium 52 can be pre-determined based on the surface area of the first layer 51 that should be dissolved. In another embodiment, the pre-determined amount of the dissolution medium 52 can be an amount that is sufficient to completely dissolve the first layer 51.

The methods include the step of introducing the wellbore isolation device containing the dissolution medium 52 into a wellbore. The step of introducing can include placing the isolation device in a desired zone. The methods also include the step of allowing the reaction to occur. The step of allowing can be performed after the step of contacting or allowing the first material to come in contact with the dissolution medium 52. At least a portion of the first layer 51 can dissolve in a desired amount of time. The desired amount of time can be pre-determined, based in part, on the specific oil or gas well operation to be performed. The desired amount of time can be in the range from about 1 hour to about 2 months. There are several factors that can affect the rate of dissolution of the first layer 51. According to an embodiment, the first material is selected such that the at least a portion of the first layer 51 dissolves in the desired amount of time.

In another embodiment, the isolation device further includes at least a second layer 54. The second layer 54 can be located between the first layer 51 and the dissolution medium 52 within the cavity. Stated another way, the first layer 51 is an outer layer to the second layer 54 such that an inner surface of the first layer 51 is proximate to an outer surface of the second layer 54. The second layer 54 comprises a second material. The second layer 54 can be configured to completely overlay or envelop the cavity 53. Therefore, the second layer 54 can substantially isolate or block the first layer 51 from coming in contact with the dissolution medium 52 contained within the cavity 53. Therefore, the second layer 54 functions as a barrier layer that substantially inhibits or prevents contact between the first layer 51 and the dissolution medium 52. According to another embodiment, the isolation device further includes a plurality of layers located between the first layer 51 and the dissolution medium 52. Each layer can be configured in a manner such that the layer acts as a barrier to delay contact between the first layer 51 and the dissolution medium 52 for a desired period of time. Any of the other layers can be, without limitation, another metal or metal alloy, a non-metal, a plastic, or sand.

The first layer 51 and the second layer 54 can be separated by a suitable distance. The composition and the thickness of the second material can be adjusted such that at least a portion of the second layer 54 can be substantially permeable to the dissolution medium after a desired period of time. The second layer 54 can comprise a frangible layer configured with a second material having a geometry that facilitates its breaking or cracking. The second material can break or crack upon impact (for example, upon engagement with a seat) or at the time of loading. After breaking or cracking, the dissolution medium 52 can then come in contact with the first layer 51. The second material can comprise glass, ceramic, brittle plastic, composites, phenols, or mixtures thereof. The second layer 54 can have a wall thickness that ranges from around 0.040 inches to around 0.25 inches. In another embodiment, the first layer 51 and/or the second layer 54 may comprise a coating. The coating can comprise aluminum oxide or any suitable composition that can retard the dissolution of the first layer 51 by the dissolution medium 52. The coated second layer 54 may have a thickness from around 0.0001 inches to 0.010 inches. The second layer can become permeable to the medium in a variety of ways, including but not limited to, fragmented, shattered, disintegrated, decomposed, dissolved, the creation of flow paths, and the like. For example, the composition and thickness of the second material can be adjusted such that the second layer 54 is dissolved within three hours to seven days after the isolation device is introduced into the wellbore. In another embodiment, substantially the entire second layer 54 is completely permeable after the desired period of time. Typically, the desired period of time is the time necessary to complete the desired oil or gas well operation.

The following is one example of a ball isolation device comprising the second layer 54. This example is not the only example that could be given, and is included for illustration purposes only. For a ball 30, the composition and thickness of the second material can be adjusted such that at least a portion of the second layer 54 becomes permeable when the second layer 54 is contacted with an impact element inside the wellbore 11. According to this embodiment, the second layer can become permeable due to a force being applied to the second layer 54. This force can cause the second layer to become fragmented or shattered, such that the second layer 54 no longer functions as a barrier layer. An impact element can be, for example, a seat 40 in a desired zone of the wellbore 11. According to this embodiment, the second layer 54 can become permeable when the ball 30 lands on the seat 40. In another embodiment, the second layer 54 can be completely permeable when the ball 30 contacts an impact element inside the wellbore 11. The impact element can also be a component of the wellbore other than a seat. In this manner, the second layer can be impacted by the impact element during the introduction of the isolation device into the wellbore.

The presence of the second layer 54 can delay the contact between the first material of the first layer 51 and the dissolution medium 52. The composition of the second material can be selected such that it is initially impervious to the dissolution medium 52. Delaying the contact between the first material and the dissolution medium 52, allows the isolation device to maintain its structural integrity at least until it is introduced into the wellbore and preferably performs the desired function. After the second layer 54 becomes permeable, the dissolution medium 52 is capable of coming in contact with the first material. The chemical reaction of at least the dissolution medium can then cause at least a portion of the first material and the first layer to dissolve.

In another embodiment, a protective coating (not shown) may be applied on an inner surface of the first layer 51. The protective coating can be a compound, such as a wax, thermoplastic, sugar, salt, or polymer that is capable of degradation or dissolving over a desired period of time. The protective coating may be applied in lieu of or in conjunction with the second layer 54. In the absence of the second layer 54, the protective coating can be in direct contact with the dissolution medium 52 contained inside the cavity 53. The protective coating can delay or further delay (that is, if a second layer 54 is located between the first layer 51 and the dissolution medium 52) the contact between the first layer 51 and the dissolution medium 52.

Generally, the smaller the cross-sectional area of first layer 51, the faster the rate of dissolution. The smaller cross-sectional area increases the ratio of the surface area to total volume of the first material, thus allowing more of the first material to come in contact with the dissolution medium 52. The cross-sectional area of the first layer 51 can be slightly larger than the cross-sectional of the second layer 54.

Another factor that can affect the rate of dissolution of the first layer 51 is the concentration of the dissolution medium 52 and the temperature of the dissolution medium 52. Generally, the higher the concentration of the dissolution medium 52, the faster the rate of dissolution of the first layer 51, and the lower the concentration of the dissolution medium 52, the slower the rate of dissolution. According to an embodiment, the concentration of the dissolution medium 52 is selected such that the at least a portion of the first layer 51 dissolves in the desired amount of time. If more than one dissolution medium 52 is used, the concentration of the dissolution media is selected such that the first layer 51 dissolves in a desired amount of time. The concentration can be determined based on at least the specific materials, such as the metals or metal alloys, selected for the first and second layers 51/54 and the bottomhole temperature of the well. According to another embodiment, one or more catalysts or retardants can be added to the dissolution medium 52 in order to accelerate or decelerate respectively the reaction of at least the dissolution medium 52. For example, the dissolution of aluminum by HCl is accelerated in the presence of mercury. According to one embodiment, since the acid dissolution reaction occurs within the closed confines of the isolation device, it progresses at a faster rate and in a more complete manner resulting in virtually the complete disappearance of the first layer. According to yet another embodiment, the acid dissolution reaction does not require any external stimulant or pressure and at least a portion of the isolation device is self-dissolvable. According to the one or more embodiments, the isolation device is a self-contained, self-dissolvable apparatus.

Moreover, the higher the temperature of the dissolution medium 52, the faster the rate of dissolution of the first layer 51, and the lower the temperature of the dissolution medium 52, the slower the rate of dissolution. One of ordinary skill in the art can select: the inclusion or non-inclusion of the second layer; the materials comprising the first and/or second layers 51/54; and the composition, volume and concentration of the dissolution medium 52 based on the anticipated wellbore temperature in order for the at least a portion of the first layer 51 to dissolve in the desired amount of time.

As can be seen in FIG. 1, the first section of tubing string 15 can be located within the first zone 13 and the second section of tubing string 16 can be located within the second zone 14. As depicted in the drawings, the isolation device can be a ball 30 (e.g., a first ball 31 or a second ball 32) and a seat 40 (e.g., a first seat 41 or a second seat 42). The ball 30 can engage the seat 40. The seat 40 can be located on the inside of a tubing string. When the first section of tubing string 15 is located downstream of the second section of tubing string 16, then the inner diameter (I.D.) of the first section of tubing string 15 can be less than the I.D. of the second section of tubing string 16. In this manner, a first ball 31 can be placed into the first section of tubing string 15. The first ball 31 can have a smaller diameter than a second ball 32. The first ball 31 can engage a first seat 41. Fluid can now be temporarily restricted or prevented from flowing into any zones located downstream of the first zone 13. In the event it is desirable to temporarily restrict or prevent fluid flow into any zones located downstream of the second zone 14, the second ball 32 can be placed into second section of tubing string 16 and will be prevented from falling into the first section of tubing string 15 via the second seat 42 or because the second ball 32 has a larger outer diameter (O.D.) than the I.D. of the first section of tubing string 15. The second ball 32 can engage the second seat 42. The ball (whether it be a first ball 31 or a second ball 32) can engage a sliding sleeve 33 during placement. This engagement with the sliding sleeve 33 can cause the sliding sleeve to move; thus, opening a port 17 located adjacent to the seat. The port 17 can also be opened via a variety of other mechanisms instead of a ball. The use of other mechanisms may be advantageous when the isolation device is not a ball. After placement of the isolation device, fluid can be flowed from, or into, the subterranean formation 20 via one or more opened ports 17 located within a particular zone. As such, a fluid can be produced from the subterranean formation 20 or injected into the formation.

FIGS. 2-4 depict the isolation device according to certain embodiments. As can be seen in the drawings, the isolation device can be a ball 30. As depicted in FIG. 2, the isolation device can comprise the first layer 51 and the second layer 54. Although this embodiment depicted in FIG. 2 illustrates the isolation device as a ball, it is to be understood that this embodiment and discussion thereof is equally applicable to an isolation device that is a bridge plug, packer, etc.

FIGS. 3 and 4 depict the isolation device according to other embodiments. As can be seen in FIG. 4, the first layer 51 has a thickness t that can be adjusted to control the rate of dissolution of the first layer 51. The isolation device shown in FIG. 4 is filled with or contains the dissolution medium 52 inside the isolation device. The dissolution medium 52 is contained within the cavity 53. Preferably, the dissolution medium 52 is selected such that after dissolution of the first layer 51, the isolation device is capable of being flowed from the wellbore 11. By way of example, if the dissolution medium 52 is HCl and the first material is aluminum, then the HCl reacts with the aluminum to form aluminum chloride and hydrogen as follows:

$$2Al+6HCl \rightarrow 2AlCl_3+3H_2$$

The hydrogen gas can be vented to the atmosphere. The aluminum chloride can be combined with, for example, water and flowed back to the surface by forming the hexahydrate, $AlCl_3.6H_2O$. The aluminum chloride can also be produced out of the well with production fluids. Production fluids can include fluids pumped for stimulation or clean-up. Production fluids can include proppant, water, gel, soda ash, etc. in addition to the desired production fluids including hydrocarbons.

As shown in FIGS. 3 and 4, at least a portion of the seat 40 can comprise a seat surface 55. According to this embodiment, at least a portion of the first layer 51 of the ball 30 can come in contact with at least a portion of the seat surface 55. Preferably, the seat surface 55 can be configured such that it is not degraded by the chemical reaction that dissolves the first layer 51. Therefore, the seat surface 55 retains its structural integrity even if there is seepage of the acid/dissolution medium 52 from the ball 30 to the seat surface 55. Therefore, in the event the ball 30 fails (or substantially fails) to function as an isolation device, a new ball that is pumped into the wellbore can be retained in the same seat 40. Moreover, for isolation devices other than a ball and seat, one or more of the components other than the first and/or second layers are not degraded by the chemical reaction of at least the dissolution medium. One of ordinary skill in the art will be able to select which components of a particular isolation device should or should not degrade from contact with the dissolution medium. In this manner, the isolation device can be flowed from the wellbore, while certain components may remain in the wellbore.

According to an embodiment, at least the first layer 51 is capable of withstanding a specific pressure differential (for example, the isolation device depicted in FIG. 3). As used herein, the term "withstanding" means that the substance does not crack, break, or collapse. The pressure differential can be the downhole pressure of the subterranean formation 20 across the device. As used herein, the term "downhole" means the location of the wellbore where the first layer 51 is located. Formation pressures can range from about 1,000 to about 30,000 pounds force per square inch (psi) (about 6.9 to about 206.8 megapascals "MPa"). The pressure differential can also be created during oil or gas operations. For example, a fluid, when introduced into the wellbore 11 upstream or downstream of the substance, can create a higher pressure above or below, respectively, of the isolation device. Pressure differentials can range from 100 to over 10,000 psi (about 0.7 to over 68.9 MPa). According to another embodiment, both, the first and second layers 51/54 are capable of withstanding a specific pressure differential (for example, the isolation device depicted in FIG. 2). According to yet another embodiment, both, the first layer 51 and the dissolution medium 52 are capable of withstanding a specific pressure differential (for example, the isolation device depicted in FIG. 4).

The methods can include the step of contacting or allowing the first material and/or the first layer 51 of the wellbore isolation device to come in direct contact with the dissolution medium 52. The step of contacting can include introducing or pre-filling the dissolution medium 52 into the cavity 53.

It may be desirable to delay contact of at least the first layer 51 with acids and fluids present in the wellbore 11. The isolation device can further include a coating on the outside of the first layer 51. The coating can be a compound, such as a wax, thermoplastic, sugar, salt, or polymer. The coating can be selected such that the coating either dissolves in wellbore fluids or melts at a certain temperature.

The methods include the step of introducing the isolation device in a portion of the wellbore 11. More than one isolation device can also be introduced in multiple portions of the wellbore 11. The methods can further include the step of removing all or a portion of the dissolved first layer 51 and/or all or a portion of the permeable second layer 54 and/or the dissolution medium 52, wherein the step of removing is performed after the step of allowing the reaction to occur. The step of removing can include flowing the dissolved first layer 51 and/or the second layer 54 and/or dissolution medium 52 from the wellbore 11. According to an embodiment, a sufficient amount of the first layer 51 is dissolved such that the isolation device virtually disappears or dissolves inside the wellbore 11. Any remnants of the isolation device can then be flowed from the wellbore 11. Accordingly, the isolation device should be capable of being flowed from the wellbore via dissolution of the first layer 51 by the dissolution medium 52, without the use of a milling apparatus, retrieval apparatus, or other such apparatuses commonly used to remove isolation devices. After removal of any remnants of the isolation device back to the surface, fluid flow can be restored between zones of the wellbore and well plugging and associated operational delays can be avoided. Additionally, a partial or complete dissolution of the isolation device in the wellbore 11 can ensure guaranteed flow assurance and quicker and cost-effective drillout times.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of removing a wellbore isolation device comprising:

introducing the isolation device into the wellbore, wherein the isolation device comprises:

(A) at least a first layer, wherein the first layer comprises at least a first material, and wherein the at least the first layer defines a cavity located within the isolation device; and (B) a dissolution medium, wherein the dissolution medium is located within the cavity, and wherein a chemical reaction of at least the dissolution medium causes at least a portion of the first material to dissolve; and allowing the chemical reaction to occur, wherein the dissolution medium comprises one or more fluids capable of dissolving the at least the portion of the first material.

2. The method according to claim 1, wherein the isolation device is capable of restricting or preventing fluid flow between a first zone and a second zone of the wellbore.

3. The method according to claim 1, wherein the isolation device is a ball, a fracturing ball, a plug, a bridge plug, a wiper plug, or a packer.

4. The method according to claim 1, wherein the chemical reaction causes at least a portion of the at least first layer to dissolve.

5. The method according to claim 1, wherein the one or more fluids are selected such that the at least the portion of the first material dissolves in a desired amount of time.

6. The method according to claim 1, wherein the one or more fluids is an acid.

7. The method according to claim 1, wherein the isolation device further comprises a second layer, wherein the second layer comprises at least a second material.

8. The method according to claim 7, wherein the second layer is a barrier layer and wherein the second layer substantially inhibits or prevents the dissolution medium from contacting the first layer.

9. The method according to claim 7, wherein the second material is selected such that the second layer becomes permeable to the dissolution medium after a desired period of time.

10. The method according to claim 9, further comprising a step of allowing the second layer to become permeable after the desired period of time, wherein the permeability of the second layer allows the dissolution medium to contact the first material.

11. The method according to claim 10, wherein the second layer becomes permeable due to a force from an impact element.

12. The method according to claim 7, wherein the at least the first layer and/or the second layer further comprises a protective coating on at least a portion of the inner surface of the first and/or second layer.

13. The method according to claim 1, further comprising the step of removing all or a portion of the dissolved portion of the first material, wherein the step of removing is performed after the step of allowing the chemical reaction to occur.

14. The method according to claim 1, wherein the at least the portion of the first material dissolves in a desired amount of time.

15. The method according to claim 1, wherein the step of introducing comprises placing the isolation device in a desired zone of the wellbore.

16. The method according to claim 1, wherein the at least the first material is selected from the group consisting of metals, metal alloys, thermoplastics, composites, and combinations thereof.

17. The method according to claim 16, wherein the metal or the metal of the metal alloy is selected from the group consisting of aluminum, iron, cobalt, beryllium, tin, nickel, copper, zinc, cadmium, and combinations thereof.

18. A wellbore isolation device comprising:

(A) a first layer, wherein the first layer comprises at least a first material, and wherein the first layer defines a cavity located within the isolation device; and (B) a dissolution medium, wherein the dissolution medium is located within the cavity, wherein a chemical reaction of at least the dissolution medium causes at least a portion of the first material to dissolve, and wherein the dissolution medium comprises one or more fluids capable of dissolving the at least the portion of the first material.

19. The method according to claim 18, wherein the isolation device is a ball, a fracturing ball, a plug, a bridge plug, a wiper plug, or a packer.

* * * * *